United States Patent [19]

Vann et al.

[11] Patent Number: 4,612,992

[45] Date of Patent: Sep. 23, 1986

[54] SINGLE TRIP COMPLETION OF SPACED FORMATIONS

[75] Inventors: Roy R. Vann, Katy, Tex.; Emmet F. Brieger, Nogal, N. Mex.

[73] Assignee: Halliburton Company, Duncan, Okla.

[21] Appl. No.: 721,536

[22] Filed: Apr. 10, 1985

Related U.S. Application Data

[63] Continuation of Ser. No. 439,076, Nov. 4, 1982, abandoned, which is a continuation-in-part of Ser. No. 384,579, Jun. 3, 1982, abandoned.

[51] Int. Cl.[4] ..... E21B 43/1185

[52] U.S. Cl. ..... 166/297; 166/55.1; 166/63; 175/4.54

[58] Field of Search ..... 166/297, 55.1, 55, 63; 175/4.52, 4.55, 4.56; 89/1 C; 102/320–322

[56] References Cited

U.S. PATENT DOCUMENTS

| | | | |
|---|---|---|---|
| 2,261,859 | 11/1941 | Ricow | 175/4.56 |
| 2,304,408 | 12/1942 | Holifield | 89/1 C |
| 2,327,141 | 8/1943 | Spencer | 89/1 C |
| 2,644,519 | 7/1953 | Kanady | 102/320 |
| 3,011,551 | 12/1961 | Young et al. | 89/1 C |
| 3,138,206 | 6/1964 | Bruce et al. | 166/55.1 |
| 3,244,232 | 4/1966 | Myers | 166/63 |
| 4,509,604 | 4/1985 | Upchurch | 175/4.56 |

*Primary Examiner*—James A. Leppink
*Assistant Examiner*—Hoang C. Dang
*Attorney, Agent, or Firm*—James R. Duzan

[57] ABSTRACT

Two or more spaced formations located downhole in a borehole are completed by employment of a string of perforating guns and by making a single trip to the wellbore. An upper and a lower gun device are tied together by a connecting tubing. The length of the tubing spaces the guns apart a selected amount. The gun string is run downhole and actuated, whereby the casing is perforated adjacent to the two spaced formations. Detonation of the upper gun forces an upper movable member associated with the connecting tubing to generate a pressure wave which is received by a lower movable member located at the upper end of the lower gun. The lower member is connected to cause detonation of the lower gun.

17 Claims, 4 Drawing Figures

SINGLE TRIP COMPLETION OF SPACED FORMATIONS

CROSS-REFERENCE TO RELATED APPLICATIONS

This application is a continuation of application Ser. No. 439,076, filed Nov. 4, 1982 now abandoned which, in turn, is a continuation-in-part of application Ser. No. 384,579, filed June 3, 1982 now abandoned by Roy R. Vann and Emmet F. Brieger and entitled, "Completion of Two Spaced Formations With a String of Guns."

BACKGROUND OF THE INVENTION

It is known to employ an extremely long string of guns connected together by a connecting tubing in order to simultaneously perforate two or more vertically spaced apart formations located downhole in a borehole. In the past, in order to cause an upper charge carrier to detonate an underlying charge carrier, it has been necessary to utilize the force of the explosion of the shaped charges in the upper charge carrier for detonating a length of prima cord which extends from the interior of one gun to the interior of another.

The use of a length of prima cord in order to connect together guns which are spaced more than 100 feet apart, for example, is cumbersome and unreliable because the guns must be physically tied together by a tubing string as they are lowered into the borehole. This is a difficult task as well as being time consuming and exceedingly dangerous. Under these trying conditions, it is easy to appreciate that the technician occasionally blunders and fails to properly assemble a gun component, whereupon one of the guns fails to perforate the casing. This gun failure necessitates the employment of a costly and difficult remedial action.

Furthermore, when prima cord is used it is often difficult to determine if both guns have been fired. If, for example, the operator relies on the detection of sounds by geophones to determine when the guns have fired, the two sets of sounds may arrive at the geophones so close together that it is impossible to determine if the sound was the result of firing one gun or both. One reason for this problem is that prima cord burns at about 30,000 feet per second, so that if the second gun is 100 feet from the first gun, it will be fired only 1/300 second later.

Another problem in the prior art is that the tubing connecting the two guns is at atmospheric pressure, filled with air, and is subjected to borehole pressures which are sometimes high enough to cause the tubing to collapse.

Another drawback of the use of prima cord to connect the guns is that the entire string of guns, including the connecting tubing, must be hermetically sealed from the well fluids, and since many of the threaded connections are made up in the field, some of these connections occasionally are not made up tightly, causing the connections to leak a sufficient amount to wet and/or foul the gun components, thereby causing the gun to misfire.

It is, therefore, desirable to have made available a reliable jet perforating gun device which is connected to another similar jet perforating gun device by a connecting tubing, wherein the gun string does not depend upon an interconnecting length of prima cord for the lower gun to be detonated in response to the detonation of the upper gun. Preferably, the lower gun should be fired in a manner which delays its firing for a period after the upper gun fires. Moreover, it is desirable to seal the individual charge carriers of the gun string at the shop or laboratory rather than having to depend upon the seals being effected at the job site, thereby reducing the likelihood of leakage of the gun components.

The method and apparatus for simultaneously perforating spaced formations in a borehole in a manner which overcomes the above drawbacks and enjoys some of the desirable features set forth above is the subject of the present invention.

SUMMARY OF THE INVENTION

The method and apparatus of the invention includes using one string of guns for completing two spaced apart formations located below the surface of the ground through which a borehole extends. The apparatus includes an upper perforating gun having a gun firing head attached thereto for detonating the shaped charges of the gun. A shock cylinder assembly is located at the lower end of the upper gun for sensing the detonation of the gun and supplying a suitable signal to a fluid pulse type firing head. The pulse type firing head is connected to detonate a lower gun which is suspended from the upper gun by a connecting tubing of a selected length to position the two guns adjacent to the vertically spaced apart formations to be completed.

When the gun firing head of the upper gun is detonated, the shaped charges of the upper gun perforate the borehole wall, thereby completing the upper formation. The shock cylinder assembly moves a movable wall member in response to detonation of the shaped charges of the upper gun. This action produces a pulse which travels down the connecting tubing to the fluid pulse firing head, which senses the pulse and detonates the shaped charges of the lower gun in response thereto, thereby perforating the borehole wall adjacent to the lower formation.

In one form of the invention, the movable wall member is in the form of a piston which is reciprocatingly received within a shock cylinder assembly. The fluid pulse firing head is a circular member, such as a disk, arranged perpendicularly to the centerline of the connecting tubing. A shaft is arranged perpendicularly to the disk and moves a firing pin into engagement with an explosive initiator. Movement of the piston produces a pulse which moves the disk with sufficient force to cause the firing pin of the disk to strike the initiator, thereby detonating the shaped charges of the lower gun.

Other guns can be added to the string as may be required to perforate and complete any number of vertically spaced apart formations by following the above teachings.

Accordingly, a primary object of the present invention is the provision of method and apparatus by which vertically spaced apart formations located downhole in a borehole can be completed by making a single trip into the borehole.

Another object of the invention is the provision of apparatus for firing a plurality of guns to perforate a plurality of spaced formations, with the time of firing being separated enough in time to be separately detected.

Another object of the present invention is the provision of apparatus by which two or more spaced formations can be simultaneously completed downhole in a borehole, with there being little danger of misfire, and with the operation being carried out in an improved and safe manner.

A further object of this invention is the provision of a method by which detonation of one jet perforating gun provides a force which is utilized to detonate the charges of another jet perforating gun.

Another and still further object of this invention is the provision of a perforating gun apparatus for perforating spaced areas in wellbores which require no fluid type connections to be effected to the gun string at the well site.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENT

Figure 1:
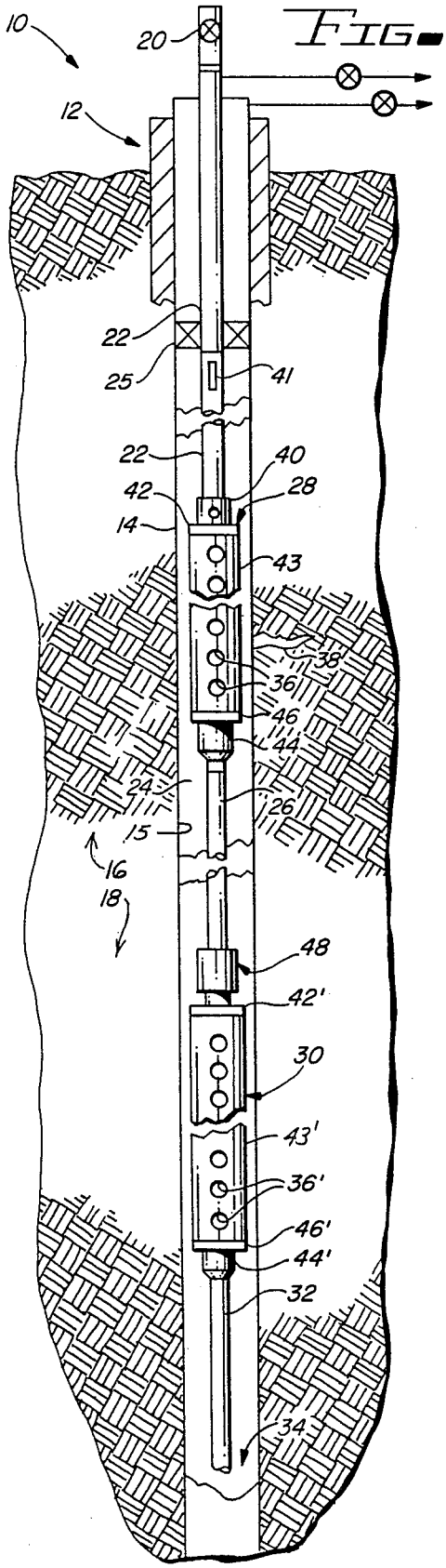
FIG. 1 is a fragmentary, vertical, cross-sectional view of a borehole formed into the earth, with the present invention being disclosed in conjunction therewith.

In FIG. 1, there is disclosed a wellbore 10 having apparatus made in accordance with the present invention associated therewith. The wellbore includes the usual wellhead 12 connected to the upper end of a casing string 14. The cased borehole extends downhole through an upper formation 16 and through a lower formation 18 located in spaced relationship relative to the upper formation 16. The cased borehole includes a lubricator 20 located at the upper extremity of a tubing string 22 extending into the wellbore. The tubing string 22 forms an annulus 24 between the illustrated string of tools and the cased borehole wall 15. A packer device 25 can be included in the tool string if desired, in order to divide the annulus into an upper and a lower annular area.

A connecting tubing 26 interconnects upper and lower perforating guns 28 and 30 with one another. Another connecting tubing 32 can be similarly employed where another even lower gun at 34 is utilized for completing another formation below lower formation 18. Tubing 26 has the advantage that not only is it not hermetically sealed but permits the entry of well fluids as described hereinafter.

Shaped charges 36 of upper carrier 28 each form a perforation tunnel 38 which extends back into upper formation 16 and permits the production fluid to flow into the annulus 24, after the formation 16 has been completed, in a manner known to those skilled in the art.

The upper perforating gun 28 includes a gun firing head 40 which is detonated in response to impact received from a free falling metal bar 41. The gun head 40 is connected to a gun sub 42, which in turn is connected to the main charge carrier 43 of upper gun 28. The gun head 40, when actuated, detonates all of the shaped charges 36 of upper perforating gun 28. Although upper gun 28 is shown detonated by bar 41, gun 28 can be detonated by any detonation means known to those skilled in the art.

A shock cylinder assembly 44, made in accordance with the present invention, is connected to a lower gun sub 46 connected to the lower end of upper gun 28 and to the beforementioned connecting tubing 26. The details of the shock cylinder assembly 44 are shown illustrated in FIG. 2.

Lower perforating gun 30 includes a fluid pulse type firing head 48. The fluid pulse type firing head 48 shown in FIG. 1 is made in accordance with the present invention, and is more fully described in FIGS. 3 and 4. The pulse type firing head 48 is connected to gun 30 by means of an upper sub 42'. A lower sub 46' is employed below lower perforating gun 30 to suspend a next lower gun. A plug can be employed at sub 46' in lieu of a second shock cylinder assembly 44' if no additional guns are desired to be used further downhole at 34. Lower gun 30 carries shaped charges 36'.

Figure 2:
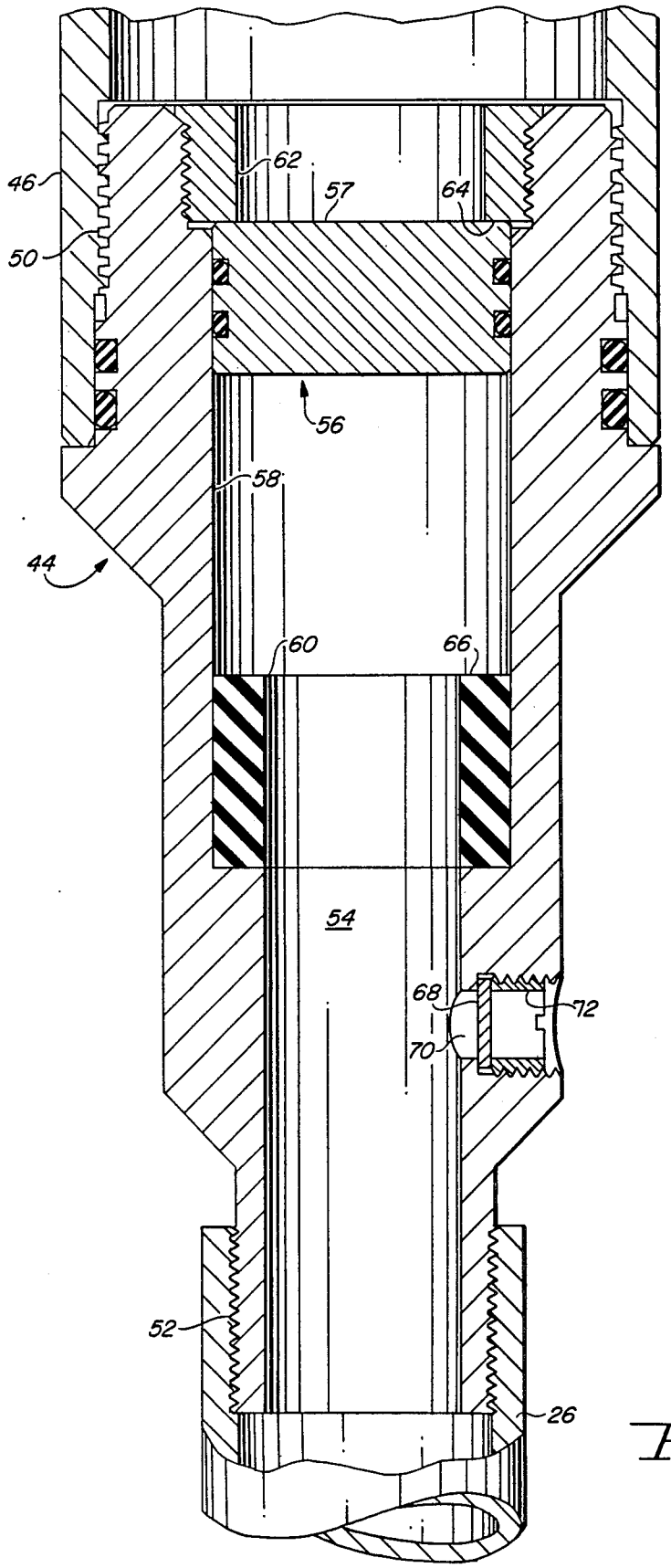
FIG. 2 is an enlarged, broken, fragmentary, longitudinal, cross-sectional view of the shock cylinder assembly of the apparatus disclosed in FIG. 1.

Referring now to FIG. 2, the shock cylinder assembly 44 is connected to lower gun sub 46 by means of threads 50. The shock cylinder includes a lower threaded pin end 52 opposed to the upper threaded end 50. Threaded pin end 52 is connected to the upper extremity of the connecting tubing 26. Axial passageway 54 is formed longitudinally through the shock assembly 44. A movable wall member 56, in the form of a piston, isolates the interior of the connecting tubing 26 from the interior of the housing of upper gun 28. The piston 56 has an upper face 57 exposed to the interior of charge carrier 43. The piston 56 includes the illustrated o-rings and is slidably received in a reciprocating manner within cylinder 58 of assembly 44 which extends from a shock absorber 60 mounted within cylinder 58 to a retainer 62 threaded into the upper end of cylinder 58. One or more vents 59 may be provided through the wall forming cylinder 58. Retainer 62 has a downwardly facing shoulder 64 circumferentially extending about the lower end of retainer 62 for abuttingly engaging piston face 57, while shoulder 66 of the shock absorber 60 provides stop means to abuttingly engage the lower face of the piston.

A pressure relief disk 68 is disposed in the wall of assembly 44 and is designed to rupture or fracture in order to relieve the internal pressure of shock cylinder assembly 44 when the pressure therewithin approaches the designed operating limitations of the tool string. The disk 68 is sealingly seated within a port 70 in the wall of assembly 44 by means of a cylindrical retainer 72.

Figure 3:
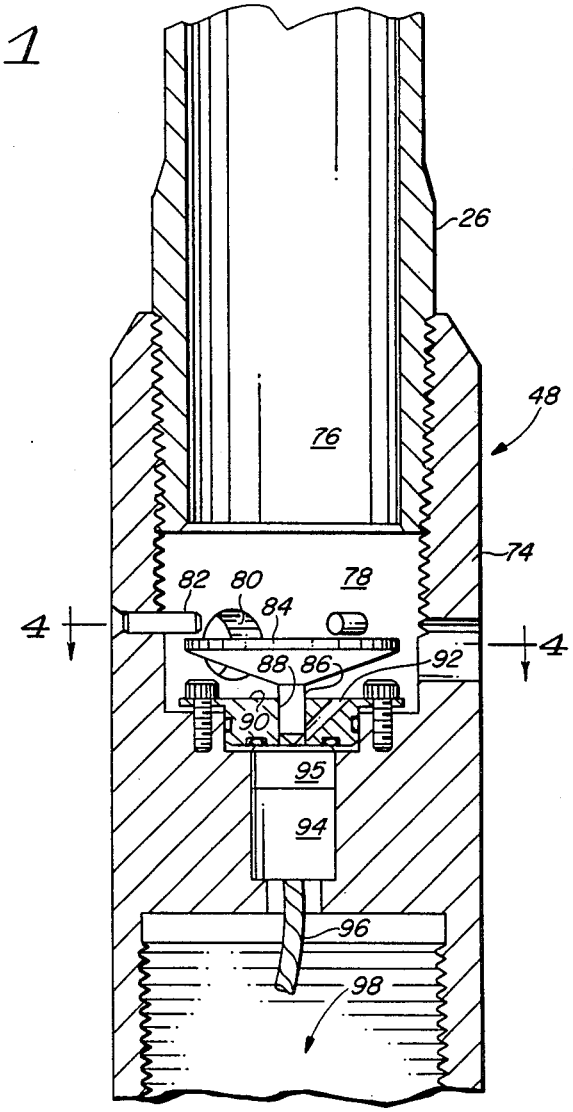
FIG. 3 is an enlarged, broken, longitudinal, part cross-sectional view of the fluid pulse type firing head disclosed in FIG. 1.
Figure 4:
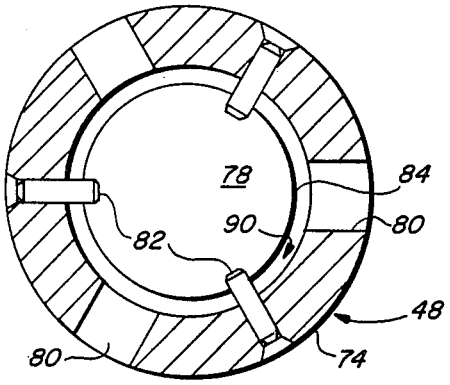
FIG. 4 is a cross-sectional view of the fluid pulse type firing head taken along line 4—4 of FIG. 3.

Referring now to FIG. 3, there is disclosed the details of the fluid pulse type firing head 48. The firing head 48 includes a main body 74 having an axial passageway 76 which communicated with an impulse sensor chamber 78. One or more circumferentially spaced relief ports 80 interconnect passageway 76 and chamber 78 with the borehole annulus 24. Circumferentially spaced retainers 82 capture a disk-like member 84 in the illustrated supported position.

Ports 80 let well fluids enter tubing 26 upon lowering the tool string into the well, but are small enough to prevent any debris from entering tubing 26. Air in the tubing is forced out through vents 59. Thus the interior of the tubing is filled with liquid at the borehole pressure, and the possibility of collapse due to this pressure is avoided. Ports 80 also act as chokes for the force transmitted down tubing 26 and are sized to insure that the shock force does not all dissipate through ports 80 so as to prevent the activation of member 84. Other relief ports may be located elsewhere in tubing 26 to control the amount of force transmitted by piston 56. For example, 20,000 psi rated perforating guns may generate a sizable shock wave as compared to connecting stress rating of tubing 26 which may have a psi rating of 10,000–12,000 psi.

Shaft 86 is reciprocatingly received within shaft hole 88 formed within a mounting member 90. The shaft 86 is made into the form of a firing pin at the lower extremity thereof. Bleed port 92 communicates with the end of the firing pin shaft 86 and provides pressure balancing so as to insure that borehole pressure will not accidentally detonate the gun.

Initiator 94 is detonated when the firing pin 86 penetrates the shock sensitive end portion 95, and this action explodes the prima cord 96, which in turn detonates the shaped charges 36' at 98 located within the charge carrier 43'. The sequential action of the explosive train 95, 94, 96, and 36' is referred to herein as though the reaction were instantaneous, when in reality the reaction occurs over a finite time interval.

In operation, the bar 41 is dropped down through the lubricator 20 and travels down through the tubing string 22 until the bar is arrested at gun firing head 40. Bar 41 generates an impact of 5 ft-lbs or more on head 40. The impact of the bar 41 against the upper firing head mechanism of head 40 results in the detonation of the shaped charges 36 of carrier 43 of the upper gun 28, thereby penetrating the upper formation 16 as indicated by the numeral at 38, and completing the upper formation.

Simultaneously, with the detonation of upper gun 28, the pressure shock wave generated by the firing of upper gun 28 is effected on face 57 of the movable wall member or piston 56. This action abruptly moves piston 56 downhole, which results in the formation of a shock wave. The shock wave travels down the axial passageway 54 of shock assembly 44, through the connecting tubing 26, through passageway 76 of pulse type firing head 48, and into the impulse sensor chamber 78 of head 48, where any displaced fluid is relieved through circumferentially disposed ports 80. The force or wave moves downward quickly traveling about 8800 feet per second, less than one-third the burning speed of prima cord.

The pulse or shock wave is effected on the upper face of disk 84, and is of a magnitude to drive disk 84 in a downward direction, causing the firing pin 86 thereof to penetrate the sensitive end 95 of the initiator 94. This action detonates the prima cord 96, which in turn detonates the shaped charges 36' in the charge carrier of the lower gun 30. The shaped charges 36' penetrate the cased borehole wall 15 at lower formation 18, and form tunnels like those seen at 38 in upper formation 16. Fluid in now free to flow from each of the spaced formations 16, 18, into the borehole annulus 24, and to the surface of the earth.

The charges 36 of the upper gun are detonated sequentially, creating a series of sounds which can be detected so that it is known when the gun is fired. The lower gun 30 fires a fraction of a second later, being delayed by the time required for the shock wave to travel, and the charges 36 of the lower gun 30 are sequentially detonated, commencing with the uppermost charge until all of the charges have been detonated. Because of the pause between the firing of the guns, the operator can determine whether one or both guns have fired.

The present invention allows the charge carriers of series connected guns to be connected together in an improved and safe manner. The safety of handling the gun tool string, and placing the tool string within the borehole is greatly increased since there is no necessity for weaving a length of prima cord from the lower gun, up through the connecting tube, into the upper gun.

The previous problem of leakage of well fluid into the tool string and contamination of the charge carriers, which invariably causes misfires, is obviated by the present invention. All of the fluid-tight connections are effected at the assembly shop where testing procedures and clean working environment assures a hermetically sealed charge carrier. Subsequently, interconnection of the guns at the wellbore is therefore less tedious than in prior art apparatus.

In one embodiment of the invention, an electrically actuated gun is used for the upper gun, although in the preferred form of this invention, an impact responsive type gun firing head is preferred as described above, and as set forth in U.S. Pat. No. 3,706,344, which is hereby incorporated by reference. Moreover, it is preferred to run the string of jet perforating guns into the borehole on a tubing string 22 rather than utilizing a wireline, although alternatively the guns may be run downhole on the end of a wireline with the uppermost gun being fired electrically.

In another embodiment, upper gun 28 is detonated by a shock wave from the surface. Other movable wall members 56 and other trigger devices 84 are also within the comprehension of this invention. Packer device 25 can be included in the gun tool string, if desired, in accordance with U.S. Pat. No. 3,871,448, which is hereby incorporated by reference.

While a preferred embodiment of the invention has been shown and described, modifications thereof can be made by one skilled in the art without departing from the spirit of the invention.

I claim:

1. A method of perforating two spaced-apart formations, comprising the steps of:

positioning a first perforating gun in a borehole adjacent to a first formation and a second perforating gun in the borehole adjacent to a second formation;

detonating the charges of the first gun to create a pressure shock wave, the pressure shock wave being generated by application of the explosive force from firing the first gun to a movable wall closing one end of a column of fluid;

directing the pressure shock wave to means for detonating the charges of the second gun; and detonating the charges of the second gun in response to said pressure shock wave.

2. A method as defined by claim 1 wherein the column of fluid impinges on a second movable wall which is moved in response to the pressure shock wave and causes a firing pin to engage the firing mechanism of the second gun.

3. A method as defined by claim 3 wherein the pressure shock wave travels longitudinally down a tubing from the first movable wall to the second movable wall.

4. The method of claim 2 wherein the first gun firing head is responsive to impact, and further including the steps of:

running the string of guns downhole on the end of a tubing string; and actuating the first gun firing head by dropping a bar down the tubing string to impact against it.

5. In a formation, completion apparatus wherein spaced upper and lower perforating guns, respectively, are positioned downhole adjacent to spaced upper and lower formations, respectively, to be completed; with the guns being connected together by a connection tubing; and, the upper gun is provided with a gun firing head for detonation of the upper gun, the improvement comprising:

a shock cylinder assembly connected to the lower end of the upper gun and to the connection tubing, a movable wall member included within said shock cylinder assembly for isolating the interior of the upper gun from the interior of the connection tubing;

an impact responsive initiator mounted at the upper end of said lower gun for detonating the shaped charges of the lower gun in response to the activation of the initiator; and a lower member movable in response to a pulse generated by the shock cylinder assembly; means mounting said lower member adjacent to the initiator, so that when the upper gun is detonated for perforating the borehole wall, the movable wall member causes a pulse to travel down to the lower member mounted adjacent the initiator, whereupon the lower member activates the initiator and the initiator detonates the shaped charges of the lower gun to perforate the borehole adjacent the lower formation.

6. The improvement of claim 5 wherein the movable wall member is a piston sealed in slidable relationship within said shock cylinder and reciprocates downwardly when a sufficient explosive force is received by the upper face thereof.

7. The improvement of claim 6 wherein the lower member is a disk laterally arranged respective to the axial centerline of the connecting tubing; a shaft arranged perpendicularly respective to the disk for impacting against and exploding the initiator when moved by the pulse generated by the piston.

8. Apparatus for completing a well, comprising:

a first perforating gun, means connected to the first perforating gun for suspending it in a borehole, a second perforating gun, a tubing connecting said first gun to said second gun to suspend the second gun axially below the first gun, a plurality of openings through the wall of the tubing whereby well liquids can flow into the tubing when it is lowered into a borehole, and air in the tubing is forced out, a piston closing the end of the tubing connected to the first gun, said piston being movable longitudinally of said tubing in response to the force created by the firing of the first gun to create a pressure shock wave travelling axially in the tubing to the end of the tubing connected to the second gun, and gun firing means positioned for impingement of said pressure shock wave and for engagement with the firing mechanism of the second gun, movable in response to said pressure shock wave to fire said second gun.

9. Apparatus for completing a well, comprising:

first perforating means for perforating one portion of the well;

second perforating means for perforating another portion of the well;

means for transmitting a fluid pulse upon detonation of said first perforating means, said means for transmitting a fluid pulse including a conduit extending between said first and second perforating means and substantially filled with fluid and movable wall means within said conduit for applying pressure to the fluid upon detonation of said first perforating means; and means for receiving said fluid pulse to actuate the detonation of said second perforating means.

10. The apparatus of claim 9 wherein said transmitting means includes piston means for forming a pulse wave in fluid disposed between said transmitting means and said receiving means.

11. The apparatus of claim 9 including a pipe string for suspending said first and second perforating means and means passing through said pipe string for actuating the detonation of said first perforating means.

12. The apparatus of claim 9 wherein said receiving means includes means responsive to the fluid pulse for igniting charges in said second perforating means.

13. The apparatus of claim 12 wherein said responsive means includes a disk member for engaging the fluid pulse, said disk member moving in response to the fluid pulse to activate a firing pin on said second perforating means.

14. The apparatus of claim 9 wherein said transmitting means includes a shock absorber means for said movable wall means upon said movable wall means applying the pressure.

15. The apparatus of claim 9 wherein said conduit includes pressure relief means for relieving the internal pressure of said conduit upon reaching a predetermined limit.

16. The apparatus of claim 9 including port means in said conduit for dissipating the fluid pulse upon detonation of said second perforating means.

17. The apparatus of claim 9, including at least one other perforating means for perforating other portions of the well;

means for transmitting a second fluid pulse upon the detonation of said second perforating means; and means for receiving said second fluid pulse to actuate the detonation of each of said other perforating means.

* * * * *